US005427264A

United States Patent [19]

Addison

[11] Patent Number: 5,427,264

[45] Date of Patent: Jun. 27, 1995

[54] OPEN TOP PLASTIC DRUM COVER

[75] Inventor: Robert A. Addison, Baton Rouge, La.

[73] Assignee: Ted Levine Drum Company, South El Monte, Calif.

[21] Appl. No.: 18,323

[22] Filed: Feb. 16, 1993

[51] Int. Cl.[6] ..... B65D 45/32

[52] U.S. Cl. ..... 220/308; 220/319; 220/320

[58] Field of Search ..... 220/319, 306, 320, 308

[56] References Cited

U.S. PATENT DOCUMENTS

| | | | |
|---|---|---|---|
| 2,523,639 | 9/1950 | Tucker | 220/61 |
| 3,344,945 | 12/1964 | Bozek | 220/53 |
| 3,696,962 | 10/1972 | Fehres | 220/60 R |
| 3,815,777 | 6/1974 | Churan | 220/46 R |
| 3,851,788 | 12/1974 | Hammes | 230/319 |
| 4,177,934 | 12/1979 | Hammes et al. | 220/319 |
| 4,201,306 | 5/1980 | DuBois et al. | 220/5 R |
| 4,344,546 | 8/1982 | Dry | 220/320 |
| 4,347,947 | 9/1982 | Hammnes | 220/378 |
| 4,674,650 | 6/1987 | Hamilton et al. | 220/319 |
| 4,709,833 | 12/1987 | Granberg et al. | 220/319 |

*Primary Examiner*—Joseph Man-Fu Moy
*Attorney, Agent, or Firm*—Thomas A. Turner, Jr.

[57] ABSTRACT

A cover for attachment to a cylindrical plastic drum, the drum having an open top end and a closed bottom end and an inside and an outside, the drum having a lifting flange on the outside thereof adjacent to the top end of the drum, the cover including a circular lid having a channel means integrally molded therewith extending around the periphery thereof for receiving the top end of the drum, the channel means having a downturned portion and a horizontal portion integrally molded together, the downturned portion being adapted to contact the outside of the top end of the drum and the flange, the downturned portion being thicker than the horizontal portion to form a tight seal with the outside of the drum when placed on the drum and connected to the drum by a locking ring.

2 Claims, 2 Drawing Sheets

OPEN TOP PLASTIC DRUM COVER

BACKGROUND OF THEE INVENTION

1. Field of the Invention

The invention relates to plastic drums. More particularly, the invention relates to plastic drum covers. Even more particularly, the invention is related to plastic drum covers for reconditioned plastic drums having lifting flanges.

2. Description of the Related Art

Single piece or one piece plastic drums are widely used to store and transport a variety of liquid and solid materials. These drums are sometimes referred to as tighthead drums. Such drums are made from a variety of polymers such as high density polyethylene, and the like.

A typical single piece or tighthead plastic drum of the prior art is shown in FIG. 1 generally indicated by the numeral 10. The drum shown in FIG. 1 has a hollow cylindrical body inside of which are placed primarily liquids, although particulate solids could be placed in the drum if desired. Drum 10 has a vertical side wall 11 and an integrally molded cover 12. Two threaded closure caps or plugs 14 and 16 permit filling and emptying of the drum. A lifting ring or flange 18 is located on the outside of drum 10 near the top of drum 10 and lid 12 and extends completely around drum 10 to facilitate lifting of the drum. Such drums are manufactured by Florida Drum Company, Inc., Plastic Division, 3300 North Hutchinson Street, Pine Bluff, Ark. 71602; Russell Stanley Corporation, 230 Half Mile Road, Red Bank, N.J. 07701; Smutfit Plastic Packaging, Inc., 1204 East 12th Street, Wilmington, Del. 19802; and Van Lear Containers, Inc., Plastic Division, 150 East North Street, Bradley, Ill. 60915. Although the tighthead plastic drums may differ in design details, they all have a lifting flange 18 of approximately the same shape and in approximately the same location.

It is common practice to re-condition or re-cycle single piece plastic drums such as drum 10 into open-top garbage cans after the drum has been used and emptied. flowever, many drums such as drum 10 are ground into pellets and re-cycled, or the drums are disposed of in a land-fill. Many drums cannot be re-conditioned without modification because the threads in the openings in the drunks in which the plugs or caps are received are damaged.

A reconditioned open-top drum 10a is shown in FIG. 2. To make drum 10*a* shown in FIG. 2, most of lid 12 is removed from drum 10 by cutting a large circular opening or hole 20 in lid 12 to enable drum 10 to re-used or re-cycled as an open-top drum 10*a*. Opening 12 is usually cut between caps or plugs 14 and 16 and the vertical side wall 11 of drum 10.

To cover drum 10, a cover of conventional design generally indicated by the numeral 22 can be molded from a plastic polymer and placed over the top 17 of drum 10*a*as shown in FIG. 2. Cover 22, shown in place on the top of drum 10*a* in FIG. 2, has a recessed circular bottom 24 and a rim 26 surrounding the bottom 24 on the edge. On the underside of cover 22 is a lip-like reinforcement 28 which fits against the inside of the top of drum 10*a*. Cover 22 also has a circular brim 32 which has a uniform thickness "W" shown in FIG. 2, and has the same thickness as bottom 24. The lip-like reinforcement 28 and the brim 32 enclose and define a groove or channel 34 for receipt of the top 17 of drum 10*a*. A gasket may be placed in channel 34. Cover 22 is held in place by a conventional ring clamp or locking ring 30.

Such drums 10*a* and covers 22 have the disadvantage of leaking contents stored therein when dropped. It is an object of the present invention to provide an improved cover for attachment to drum 10*a* to provide an open top drum with improved resistance to leakage of liquid and solid contents when dropped.

U.S. Pat. No. 2,523,639 discloses reconditioning and converting containers of the steel drum class including a sheet metal tubular body having a side wall of circular section, a sheet metal head having a tubular side wall of circular section, telescoped into the body side wall, and the two side walls rolled upon each other at their tubular ends and providing a chine, having a rounded annular end edge, and having a shoulder on the outside of the body side wall spaced from the end edge; a large access opening through the head; an annular gasket of rubber or like compressibly deformable material having a concave annular recess fitting over and embracing the chine and having recess side walls terminating short of the shoulder and the recess bottom engaging the rounded end edge of the chine, and the gasket having a sealing surface axially outward of the chine; the annular gasket being formed to normally fit upon the aforesaid chine when the drum is of minimum diameter in the range of commercial diameters, and the gasket material being elastic to cause the gasket to fit as aforesaid upon the chine when the drum is of the maximum diameter in the range; a circular sheet metal head having an annular side wall telescopable into the drum side wall at the chine end, and the head side wall terminating axially outwardly in a radially outwardly extending flange formed to provide an annular channel concavely confronting the gasket covered chine; the head side wall being of a diameter to telescope as aforesaid into the drum when it is of the aforesaid minimum diameter; the channel being of greater radial dimension than the gasket covered chine to concavely confront as aforesaid the gasket covered chine of the drum when its diameter is any diameter in the aforesaid range of diameters; a sheet metal, annular, radially inwardly concave, channel-form, formed to embrace between its channel side walls the head channel axially outwardly thereof and the chine shoulder, when radially constrictingly, and to sealingly press the head channel bottom upon the gasket sealing surface and the gasket recess bottom upon the chine end; and a detachable device to retain the constricted clamping ring in constricted clamping condition to sealingly, detachably, mount the head on the drum.

U.S. Pat. No. 3,344,945 discloses a resealable can including a can body having an open upper end portion of a reduced diameter connected to the remainder of the can body by an intermediate shoulder, and a can end closing the can body open upper end, the can end including an end panel and a depending skirt, the skirt having the same external diameter as the remainder of the can body and an inwardly reversely turned curl at the lower edge of the skirt closely fitting the can body upper end portion and frictionally retaining the can end on the can body.

U.S. Pat. NO. 3,696,962 discloses a liquid sealed container which has a liquid tight lid retained by a locking ring with a resilient sealing member held within a channel-shaped profiled edge. To prevent undue compression of the sealing member when other heavy articles are piled on top of a container, the inner periphery of the container has a recess engaged by the inner flange on the channel-shaped profiled edge of the lid.

U.S. Pat. No. 3,815,777 discloses a reusable plastic closure with ring seal combination which includes, generally, a closure having an annular inverted U-shaped channel about its top wall structure into which the upper edge of the open end of the container is received. The upper edge of the container has a bead or curl on it, and the outer annular wall of the U-shaped channel has an interlocking device on its interior surface which interlocks with the curl on the container to removably affix the closure to the container. The ring seal is of metal and is affixed to the container and closure by crimping the annular outer flange against the annular outer wall of the U-shaped channel in a fashion such as to forcibly urge the interlocking device into tight locking engagement beneath the curl. The ring seal is secured to the container and the closure by this crimping action, but its edge is not folded under the curl so that the ring seal can be removed far easier than in the past.

U.S. Pat. No. 3,851,788 discloses a plastic drum with removable cover and locking ring. The neck portion, extending above the bead of a plastic drum, is provided with an in-bulging section adjacent its top, to form an annular bead of smaller diameter than the neck, and with a plurality of circumferentially spaced, out-bulging extensions, each of which has a lower surface slanting upward away from the neck. A tightly fitting cylindrical cover, which is not quite as long as the neck, and fits over the latter, has a recessed top and a lip-like reinforcement extending downward from the underside of the recessed top to form an annular groove of such width as to accommodate the bead on the neck of the drum. The cover has cut out portions through which the bulge-like extensions have upper surfaces slanting away from the cover at such an angle that, with the lower surfaces of adjacent bulges on the neck, they define an acute angle. A spring steel locking ring engages these surfaces to draw the cover down tight about the neck and seal the drum.

U.S. Pat. No. 4,177,934 discloses a container and lid. The container has a body portion, a neck portion and a radially outwardly extending flange intermediate and integral with the body and neck portions is blow molded in a mold which has at least two mold elements one of which is mounted on the other for displacement in the axial direction of the mold. The mold elements have chambers which substantially conform in shape to those of the body and the neck portions of the container, the mold elements together defining an annular recess in which an intermediate portion is formed during the blow-molding operation, such portion having a pair of radially outwardly extending sections, and a connection section extending between radially outward marginal portions of the radial sections. After the blow molding operation, while the material in the mold is still in a flowable state, the mold sections are displaced relative to one another to press the radial sections toward and against one another to fuse the same into a unitary flange having an axial thickness substantially twice that of the neck and body portions. A lid of the container has an external wall which surrounds the neck portion and has an additional flange, and a ring-shaped connecting element urges the flange and the additional flange toward one another in the axial direction of the container to sealingly contact a sealing ring with the lid anti the neck portion, respectively.

U.S. Pat. No. 4,201,306 discloses a variable capacity all-plastic drum which permits a variety of sizes and capacity of drum by utilizing an extruded tube for the drum side walls of selected diameter and length proportional to the drum capacity desired. An injection molded bottom closure is welded to the bottom end of the tube by a thermoplastic bonding material having dispersed iron particles which are excited when exposed to induction heating thereby facilitating the melting of the thermoplastic. This welding material is disposed within a cavity defined by the bottom closure and bottom end of the tube and when subjected to induction heating and pressure fills the cavity to effectuate the bond between surfaces of the bottom closure and bottom end of the tube. A tight head drum is formed by securing by a similar welding technique a top closure to the upper end of the tube. In forming an open head drum, a thermoplastic chime is initially welded in similar fashion to the upper end of the tube. Thereafter, a top cover is releasably secured to the chime by a locking rim assembly.

U.S. Pat. No. 4,344,546 discloses a reusable tight head drum by conversion to open head drum. The elements making up the closure of a tight head drum which enables conversion to open head drum for reuse of the drum in which the drum is formed with a curl at the upper end on which an annular loop of a top head is secured by a banding ring member having a leg portion which is turned inwardly and upwardly to secure the loop onto the curl in a high strength sealed engagement.

U.S. Pat. NO. 4,347,947 discloses a container and cover with two gasket seals. A plastic container for storing fluids having a neck with an opening closed by means of a plastic cover is disclosed. An annular portion of the cover surrounds the neck thus providing an inner rim and an outer rim in the cover. A first gasket inserted between these rims is pressed against the upper edge of the neck and a second radially and axially supported gasket between the cover and the neck are compressed tinder the action of a device for biasing the cover toward the neck to seal the cover on the container. Devices are provided to limit the motion of the cover axially toward the neck to seal the cover on the container.

U.S. Pat. NO. 4,674,650 discloses a container and cover fastening means which is a plastic container with an inverted V-shaped rim at the upper edge of its body. The rim configuration makes it easy to pour contents from the container and, after pouring, any material remaining on the rim will slide off. A cover with a V-shaped flange mates with the rim which holds it out of contact with the inner and outer surface of the body wall. The cover also has a pocket containing a sealing ring which is passed against the rim by a locking strap to seal the container.

U.S. Pat. No. 4,709,833 discloses a rotationally molded salvage drum and recessed lid. An improved rotationally molded salvage drum and double-walled reinforced recessed lid is sealed and secured with a conventional ring clamp, and is provided with vertical column ribs projecting outward from generally cylindrical sidewalls; in a preferred embodiment the diameter of the lower section is smaller than that of the upper section to permit nesting of the empty stacked drams.

SUMMARY OF THE INVENTION

In accordance with the present invention there is provided a cover for attachment to a cylindrical plastic drum, the drum having an open top end and a closed bottom end and an inside and an outside, the drum having a lifting flange on the outside thereof adjacent to the top end of tile drum, the cover including a circular lid having a channel means integrally molded therewith extending around the periphery thereof for receiving the top end of the drum, the channel means having a downturned portion and a horizontal portion integrally molded together, the downturned portion being adapted to contact the outside of the top end of the drum and tile flange, the downturned portion being thicker than the horizontal portion.

The covers of the present invention have the advantage of forming a superior, tight seal with an open top plastic drum having a lifting flange.

The covers of the present invention have the additional advantage of being low in cost and easily and quickly attachable to conventional open top plastic drums having lifting flanges.

DESCRIPTION OF THE PREFERRED EMBODIMENTS

Figure 1:
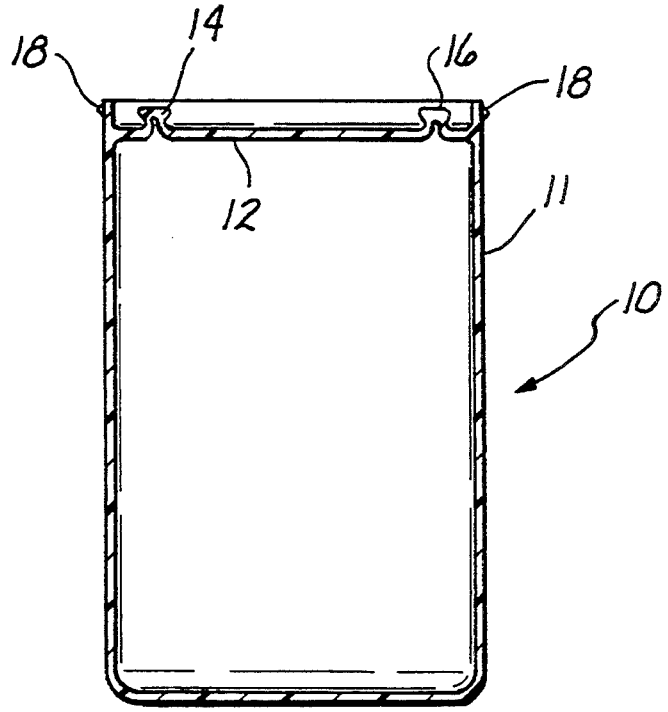
Fig. 1 PRIOR ART
FIG. 1 is an elevational sectional view of a closed top plastic drum of the prior art.
Figure 2:
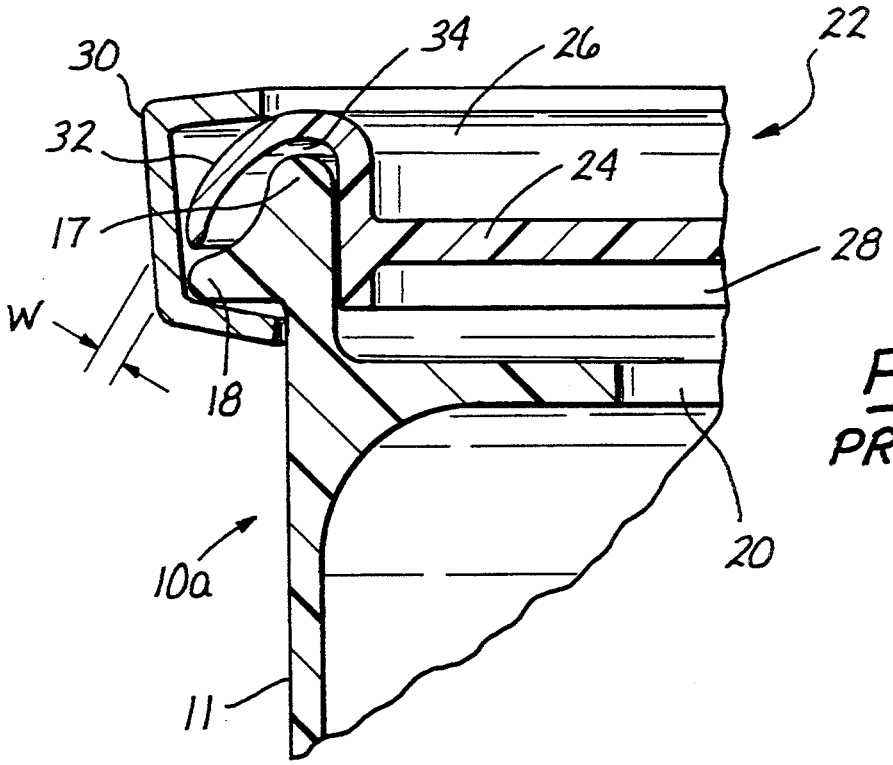
Fig. 2 PRIOR ART
FIG. 2 is a fragmentary sectional view of an open top drum of the prior art having a cover of conventional design thereon.
Figure 3:
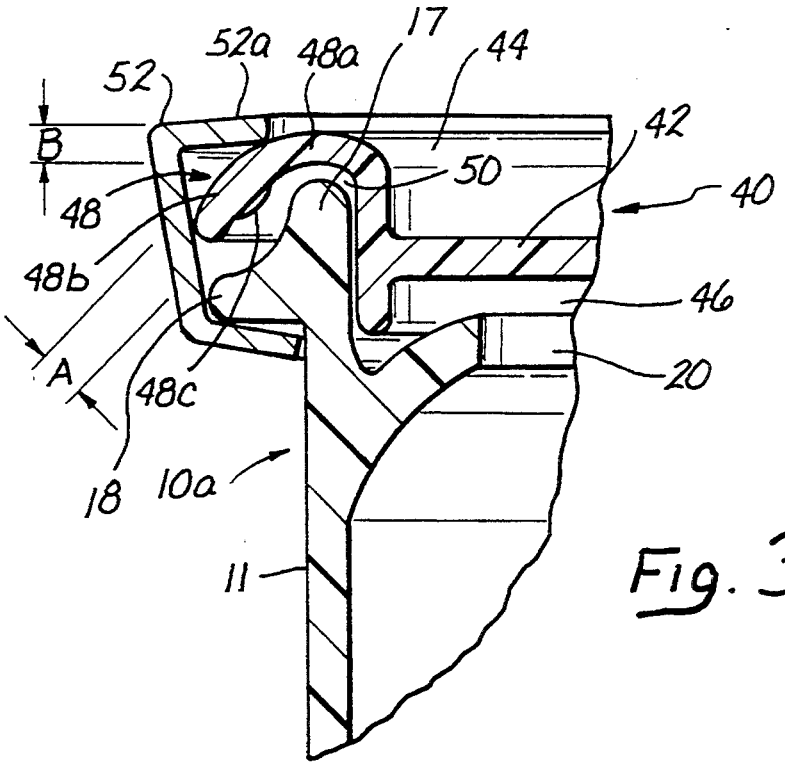
FIG. 3 is a fragmentary sectional view of an open top plastic drum having a first embodiment of the cover of tile invention connected thereto.

Referring now to the drawings, in FIG. 3 is shown an open top plastic drum generally indicated by the numeral 10*a* which call be made from a typical single piece or tighthead plastic drum of the prior art. Drum 10*a* shown in FIG. 3 is similar to drum 10*a* shown in FIG. 2 and is described hereinabove under the heading "BACKGROUND OF THE INVENTION". As previously described, drum 10*a* has a hollow cylindrical body and a vertical side wall 11. An opening 20 is provided in the top of drum 10*a*. A lifting ring or flange 18 is located on the outside of drum 10*a* near the top of drum 10*a* and extends completely around drum 10*a* to facilitate lifting of the drum.

The cover of the invention is generally indicated by the numeral 40 in FIG. 3 and is preferably molded from a plastic polymer such as high density polyethylene, although other polymers may be used if desired. Cover 40, shown in place on the top 17 of drum 10*a* in FIG. 3, has a recessed circular bottom 42 and a rim 44 surrounding the bottom 42 on the edge. On the underside of cover 40 is a lip-like reinforcement 46 which fits against the inside of the top 17 of drum 10*a*.

Cover 40 also preferably has a circular brim generally indicated by the numeral 48. Brim 48 has a horizontal portion 48*a* and a downward turned portion 48*b*. The lip-like reinforcement 46 and the circular brim 48 enclose and define a groove or channel 50 for receipt of the top 17 of drum 10*a*. If desired, a gasket may be placed in channel 50. If liquids are placed in drum 10*a*, a gasket should be used. If solids are placed in drum 10*a*, a gasket can be used but is not required.

Cover 40 is held in place by a conventional locking ring or ring clamp 52 such as the locking ring shown in U.S. Pat. No. 3,696,962, which is hereby incorporated by reference. Cover 40 in FIG. 3 is shown after placement of locking ring or ring clamp 52 around cover 40 but prior to tightening locking ring or ring clamp 52 around cover 40 and the top 17 of drum 10*a*. When locking ring or ring clamp 52 is tightened, horizontal portion 48*a* of brim 48 is forced downward onto top 17 of drum 10*a*, and downward turned portion 48*b* of brim 48 is forced toward the outside of drum 10*a* between flange 18 and the top 17 of drum 10*a*.

To enhance the ability of cover 40 to form a superior seal with the top 17 and flange 18 of drum 10*a*, the thickness "A" of the downward turned portion 48*b* of brim 48 is sufficiently large enough to partially fill the space between the top 17 and the flange 18 when locking ring or ring clamp 52 is tightened and form a tight seal with drum 10*a*. When ring clamp 52 is tightened, horizontal portion 48*a* is forced to touch and seal against top 17. Since the thickness "A" of the downturned portion 48 is greater than the thickness "B" of horizontal portion 48*a*, downturned portion 48 has much greater resistance to sliding between top leg 52*a* of ring 52 and the top 17 of drum 10*a*, thus preventing escape of the contents contained in drum 10a when the drum 10*a* is dropped diagonally on its edge.

Preferably the thickness "A" is larger than the thickness "B" of horizontal portion 48*a* cover 40. Preferably the ratio of the thickness "A" of 48*b* to the thickness "B" of 48*a* is from about 4:1 to about 1.5:1, more preferably about 3:1 to about 2:1, and most preferably, about 2:1. A typical thickness "B" of horizontal portion 48*a* of a preferred cover 40 is 0.125 inches.

As seen in the drawings, the thickness of circular bottom 42 of cover 40 is preferably greater than the thickness of horizontal portion 48*a* to provide the desired strength of cover 40. However, the thickness of horizontal portion 48*a* of cover 40 could be the same as of the thickness of circular bottom 42 of cover 40 if desired.

Most preferably, downturned portion 48*b* of brim 48 has a bead 48*c* thereon as shown in FIG. 3. Bead 48*c* extends from the inside of downturned portion 48*b* toward the outside of top 17 and flange 18 of drum 10*a* between flange 18 and top 17. Bead 48*c* can be seen in the drawings to be included in the thickness "A". When locking ring or ring clamp 52 is tightened, horizontal portion 48*a* of brim 48 is forced downward onto top 17 of drum 10*a*, and downward turned portion 48*b* of brim 48 is forced toward the outside of drum 10*a* between flange 18 and the top 17 of drum 10*a*, causing bead 48*a* to form a strong, tight seal with drum 10*a*. When drum 10*a* is dropped, bead 48*c* has great resistance to sliding pass between the top 17 and the top leg 52*a* of ring 52.

Figure 4:
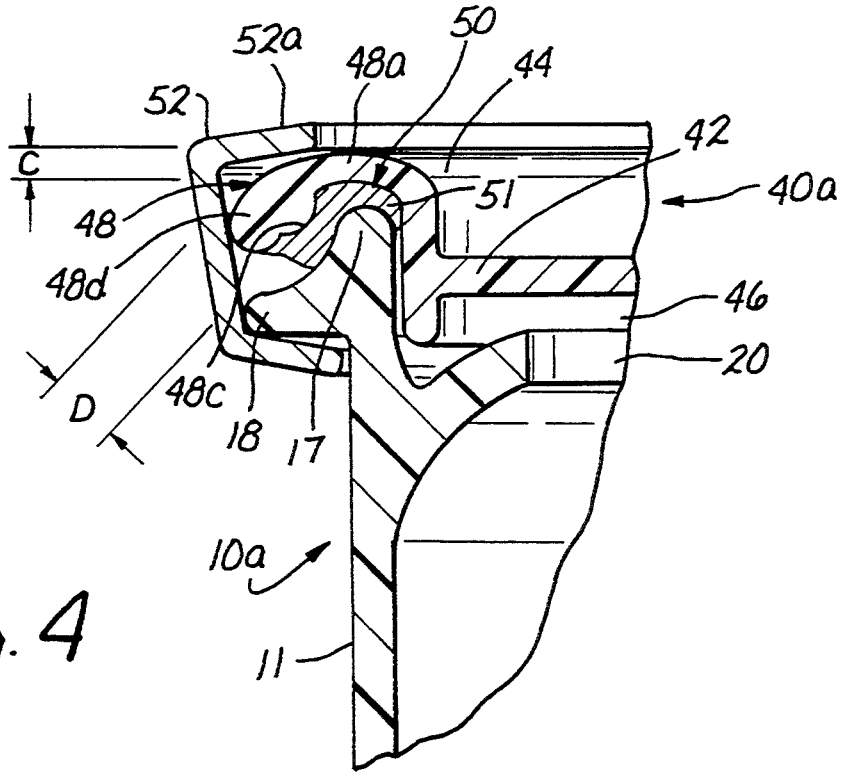
FIG. 4 is a fragmentary sectional view of an open top plastic drum having a second embodiment of the cover of the invention connected thereto.

Referring now to FIG. 4, there is shown cover 40*a* which is identical to cover 40 shown in FIG. 3, except that downward turned section 48*d* shown in FIG. 4 is slightly larger than downward turned section 48*b* of FIG. 3, and a gasket 51 is utilized in the embodiment of FIG. 4.

In FIG. 4 is shown an open top plastic drum generally indicated by the numeral 10*a* which can be made from a typical single piece or tighthead plastic drum of the prior art. Drum 10*a* shown in FIG. 4 is similar to drum 10*a* shown in FIG. 2 and FIG. 3 and is described hereinabove under the heading "BACKGROUND OF THE INVENTION". As previously described. drum 10*a* has a hollow cylindrical body and a vertical side wall 11. An opening 20 is provided in the top of drum 10*a*. A lifting ring or flange 18 is located on the outside of drum 10*a* near the top of drum 10*a* and extends completely around drum 10*a* to facilitate lifting of the drum.

The cover of the invention is generally indicated by the numeral 40*a* in FIG. 4 and is preferably molded from a plastic polymer such as high density polyethylene, although other polymers may be used if desired. Cover 40*a*, shown in place on the top 17 of drum 10*a* in FIG. 4, has a recessed circular bottom 42 and a rim 44 surrounding the bottom 42 on the edge. On the underside of cover 40*a* is a lip-like reinforcement 46 which fits against the inside of the top 17 of drum 10*a*.

Cover 40*a* also preferably has a circular brim generally indicated by the numeral 48. Brim 48 has a horizontal portion 48*a* and a downward turned portion 48*d*. The lip-like reinforcement 46 and the circular brim 48 enclose and define a groove or channel 50 for receipt of the top 17 of drum 10*a*. A gasket 51 is placed in channel 50.

Cover 40*a* is held in place by a conventional locking ring or ring clamp 52. Cover 40*a* in FIG. 4 is shown after placement of locking ring or ring clamp 52 around cover 40*a* but prior to tightening locking ring or ring clamp 52 around cover 40*a* and the top 17 of drum 10*a*. When locking ring or ring clamp 52 is tightened, horizontal portion 48*a* of brim 48 is forced downward onto top 17 of drum 10*a*, and downward turned portion 48d of brim 48 is forced toward drum 10*a* between flange 18 and the top 17 of drum 10*a*.

To enhance the ability of cover 40*a* to form a superior seal with the top 17 and flange 18 of drum 10*a*, the thickness "D" of the downward turned portion 48*b* of brim 48 is sufficiently large enough to partially fill the space between the top 17 and the flange 18 when locking ring or ring clamp 52 is tightened and form a tight seal with drum 10*a*. When ring clamp 52 is tightened, horizontal portion 48*a* is forced to touch and seal against top 17. Since the thickness "D" of the downturned portion 48 is greater than the thickness "C" of horizontal portion 48*a*, downturned portion 48 has much greater resistance to sliding between top leg 52*a* of ring 52 and the top 17 of drum 10*a*, thus preventing escape of the contents contained in drum 10*a* when the drum 10*a* is dropped diagonally on its edge.

Preferably the thickness "D" is larger than the thickness "C" of horizontal portion 48*a* cover 40*a*. Preferably the ratio of the thickness "D" of 48*d* to the thickness "C" of 48*a* is from about 4:1 to about 3:1, most preferably about 3:1. A typical thickness "C" of horizontal portion 48*a* of a preferred cover 40*a* is 0.125 inches.

As seen in the drawings, the thickness of circular bottom 42 of cover 40 is preferably greater than the thickness of horizontal portion 48*a* to provide the desired strength of cover 40. However, the thickness of horizontal portion 48*a* of cover 40 could be the same as of the thickness of circular bottom 42 of cover 40 if desired.

Most preferably, downturned portion 48*d* of brim 48 has a bead 48*c* thereon as shown in FIG. 4. Bead 48*c* extends from the inside of downturned portion 48*d* toward the top 17 and flange 18 of drum 10*a* between flange 18 and top 17. Bead 48*c* can be seen in the drawings to be included in the thickness "D". When locking ring or ring clamp 52 is tightened, horizontal portion 48*a* of brim 48 is forced downward onto top 17 of drum 10*a*, and downward turned portion 48*d* of brim 48 is forced toward the outside of drum 10*a* between flange 18 and the top 17 of drum 10*a*, causing bead 48*c* to form a strong, liquid tight seal with drum 10*a*. When drum 10*a* is dropped, bead 48*c* has great resistance to sliding between the top 17 and the top leg 52*a* of ring 52.

Although the preferred embodiments of the invention have been described in detail above, it should be understood that the invention is in no sense limited thereby, and its scope is to be determined by that of the following claims:

What is claimed is:

1. In a drum and lid combination having:

i) a drum having a cylindrical sidewall and a planar upper end extending radially inwardly from said sidewall and having a hole therethrough, said cylindrical sidewall extending upwardly from said upper end and terminating in a circular top, and having a lifting flange extending perpendicularly and radially outward from said cylindrical sidewall defining a concave indented groove between said lifting flange and said circular top, indented inwardly toward said drum sidewall, and ii) a substantially circular cover for fitting horizontally inside said cylindrical sidewall and above said upper end of the drum, said cover having a bottom having a circular periphery terminating in a lip-like reenforcement extending downwardly from said bottom around said periphery, and terminating in a rim extending upwardly from said bottom around said periphery, said rim extending further into a brim extending radially from said circular cover first in a horizonal direction and then in a generally downward direction to define an annular channel fitting over said circular top of said drum sidewall, said brim and said rim each having a thickness in cross section, iii) an annular locking ring having an inwardly facing channel fitting over said brim of said cover, and under said lifting flange of said drum sidewall, and clamping said brim to said circular top, the improvement comprising a bead formed in said brim on the downward extension of said brim and fitting in and adjacent said concave indented groove defined between said lifting flange and said circular top on said sidewall, said bead causing an increase in the thickness of said brim.

2. The drum and lid combination of claim 1 wherein said thickness of said brim increased by said bead is from 1.5 to 4 times the thickness of said brim not increased by said bead.

* * * * *